US008342465B2

(12) United States Patent
Koder

(10) Patent No.: US 8,342,465 B2
(45) Date of Patent: Jan. 1, 2013

(54) HEIGHT ADJUSTABLE COLUMN, IN PARTICULAR FOR TABLES

(76) Inventor: Michael Koder, Plochingen (DE)

( * ) Notice: Subject to any disclaimer, the term of this patent is extended or adjusted under 35 U.S.C. 154(b) by 46 days.

(21) Appl. No.: 12/602,129

(22) PCT Filed: Jun. 2, 2008

(86) PCT No.: PCT/EP2008/004364

§ 371 (c)(1),
(2), (4) Date: Nov. 27, 2009

(87) PCT Pub. No.: WO2008/145399

PCT Pub. Date: Dec. 4, 2008

(65) Prior Publication Data

US 2010/0187380 A1 Jul. 29, 2010

(30) Foreign Application Priority Data

May 31, 2007 (DE) ..... 10 2007 025 215

(51) Int. Cl.
*F16M 11/26* (2006.01)

(52) U.S. Cl. ..... 248/188.5; 248/404; 108/147

(58) Field of Classification Search ..... 248/188.5, 248/161, 404, 405, 414, 159, 157, 188.2; 108/147; 74/89.28

See application file for complete search history.

(56) References Cited

U.S. PATENT DOCUMENTS

| | | | | |
|---|---|---|---|---|
| 2,857,226 | A * | 10/1958 | Schenk | 108/147 |
| 5,941,182 | A * | 8/1999 | Greene | 108/147 |
| 6,070,840 | A * | 6/2000 | Kelley et al. | 248/188.4 |
| 6,148,741 | A * | 11/2000 | Motta | 108/96 |
| 6,474,246 | B2 * | 11/2002 | Hsu | 108/147 |
| 7,364,124 | B2 * | 4/2008 | Yuasa et al. | 248/125.8 |
| 7,559,516 | B2 * | 7/2009 | Koder | 248/188.5 |
| 7,908,981 | B2 * | 3/2011 | Agee | 108/147 |
| 2003/0033963 | A1 * | 2/2003 | Doyle | 108/147.19 |
| 2003/0146425 | A1 * | 8/2003 | Drake et al. | 254/264 |
| 2006/0156837 | A1 * | 7/2006 | Stoelinga | 74/89.2 |
| 2010/0301186 | A1 * | 12/2010 | Chuang | 248/422 |

FOREIGN PATENT DOCUMENTS

| | | |
|---|---|---|
| DE | 29619061 U1 | 12/1996 |
| DE | 29909336 | 7/1999 |
| DE | 20311574 U1 | 11/2001 |

* cited by examiner

*Primary Examiner* — Anita M King
(74) *Attorney, Agent, or Firm* — Dickinson Wright PLLC

(57) ABSTRACT

A height adjustable column, comprising an inner column, an intermediate column having a lower side, an outer column having a lower side, a lifting mechanism having at least a twofold transmission, and a linear actuator. The height adjustable column effects height adjustment by sliding the columns into each other and apart from each other. The linear actuator is dimensioned and arranged such that it protrudes beyond the lower side of the outer column in a state in which the columns are slid into each other.

13 Claims, 3 Drawing Sheets

HEIGHT ADJUSTABLE COLUMN, IN PARTICULAR FOR TABLES

CROSS REFERENCE TO RELATED APPLICATIONS

The present application is a 35 U.S.C. §371 national stage filing of International Patent Application No. PCT/EP2008/004364, filed Jun. 2, 2008, and through which priority is claimed to German Patent Application Serial Number DE 10 2007 025 215.5, filed May 31, 2007, the disclosure of which is incorporated herein by reference in its entirety.

The present invention relates to a height adjustable column, in particular for tables. Nowadays, a height adjustment of a table, as for example a desk, belongs to the basic ergonomic requirements for manufacturers of office furniture systems. Table legs in form of guided columns and/or complete underframes for tables enable to individually adjust tables to fit each user.

Such height adjustable columns, as is known, consist of an inner column, an intermediate column and an outer column, which are slidable into each other and extendable with respect to each other, whereby the height can be adjusted. Thereby, the height adjustment may be performed by a lifting mechanism, which may be performed manually, as well as servo-assisted as well as merely electrically. Thereby, amongst others, it exists the object to integrate a drive within the table leg and to achieve a maximized height adjustment. These requirements are only partially satisfied by the solution concepts known yet. In the common solutions, either the required heights are not achieved or the visual requirements are not satisfied, since e.g. in most cases the drive for the lifting mechanism is attached perpendicularly to the lifting direction outside of the actual installation space of the column. This implies, on the one hand, that a further work step is necessary, namely to fix the drive e.g. at the lower side of the table top (further implicating a detriment, since then the drive may not be performed until assembling of the table, i.e. at the customer and not within an efficient pre-fabrication at the manufacturer), and, on the other hand, that the visual requirements for a straight design are not satisfied. If a drive which is too large in size is installed into the table leg, an installation size of the table leg is necessary, which likewise does not satisfy the visual requirements for a slender design. In addition, in many known solutions, there is a problem that the sequence of motion of the visible parts, namely the column elements, being extendable with respect to each other and slidable into each other, is not synchronous or forcedly controlled, such that the user, while operating the drive for height adjustment of the table leg, can be irritated when two or more column elements are operated in parallel and the sequence of motion of the different parts does proceed synchronously. A further disadvantage of the yet known solution concepts lies in that the required heights are not achieved.

Therefore, it is an object of the present invention to create height adjustable columns in particular for desks, having an internal drive, comprising a large lift in comparison to the basic height while having a visually appealing small cross-section, wherein the lift of the column ought to be almost as large as or larger than the basic height of the column. It ought to be ensured that even smaller persons can work at such a table while sitting, and that a sufficient table elevation can be achieved for tall persons for a standing working position.

This object is solved by the features of claim 1. Advantageous further developments of the invention are subject-matter of the sub-claims.

The object is solved according to the invention by providing a height adjustable column comprising an inner column, an intermediate column and an outer column. A twofold-transmitting lifting mechanism together with a linear actuator provides for a synchronous progress of the height adjustment of the individual column elements. The lift of the column in fact is as large as or larger than the basic height of the column. This is achieved by dimensioning and arranging the linear actuator such that it extends beyond a lower side of the outer column in the retracted state.

Thereby it is possible that the linear actuator can be inserted downwardly into the installation space of a foot fixed to the height adjustable column. The foot hereby comprises a hollow which is open towards the height adjustable column via an opening, such that the linear actuator can protrude into the hollow of the foot in the retracted state.

Preferably, the linear actuator is guided in a seating which is provided at the lower side of the intermediate column, wherein the linear actuator is able to support itself on the seating.

The linear actuator preferably consists of a driving motor, a threaded spindle driven by the driving motor and a spindle nut provided rotationally fixed in the seating, the threaded spindle moving alongside the spindle nut while rotating. Herewith, the drive motor is connected with the inner column, such that, while rotating the threaded spindle, the drive motor together with the threaded spindle displaces the inner column, since the threaded spindle supports itself on the spindle nut, which is provided in the seating which is fixed to the intermediate column. Thereby, a height adjustment of the inner column can be caused.

However, the linear actuator may also consist of a plunger and a pneumatic spring or of any other driving means allowing a linear adjustment.

The seating of the linear actuator preferably also protrudes beyond the lower side of the outer column into the opening of the foot. Advantageously, a fixing between the seating and the foot may also be provided.

The lifting mechanism preferably consists of a thrust plate which is fixed to the intermediate column and possesses return pulleys at the lower and the upper end, respectively, via which a steel rope or a belt is guided. At its one end, the steel rope or belt is fixed to the inner column and its other end is fixed to a bearing rod of the outer column. When the linear actuator is operated, a motion of the inner column occurs which simultaneously causes the movement of the intermediate column, since the threaded spindle supports itself on the seating which is fixed to the intermediate column. Simultaneously therewith, however, also the intermediate column is moved with respect to the outer column, since the thrust plate is fixed to the intermediate column and supports itself via the lifting mechanism onto the bearing rod which is fixed to the outer column. Such, a synchronous movement of the inner column and the intermediate column occurs, as soon as the linear actuator is operated.

The invention, as well as further advantageous features, are explained in more detail in the following by means of an embodiment with reference to the enclosed drawings.

Figure 1:
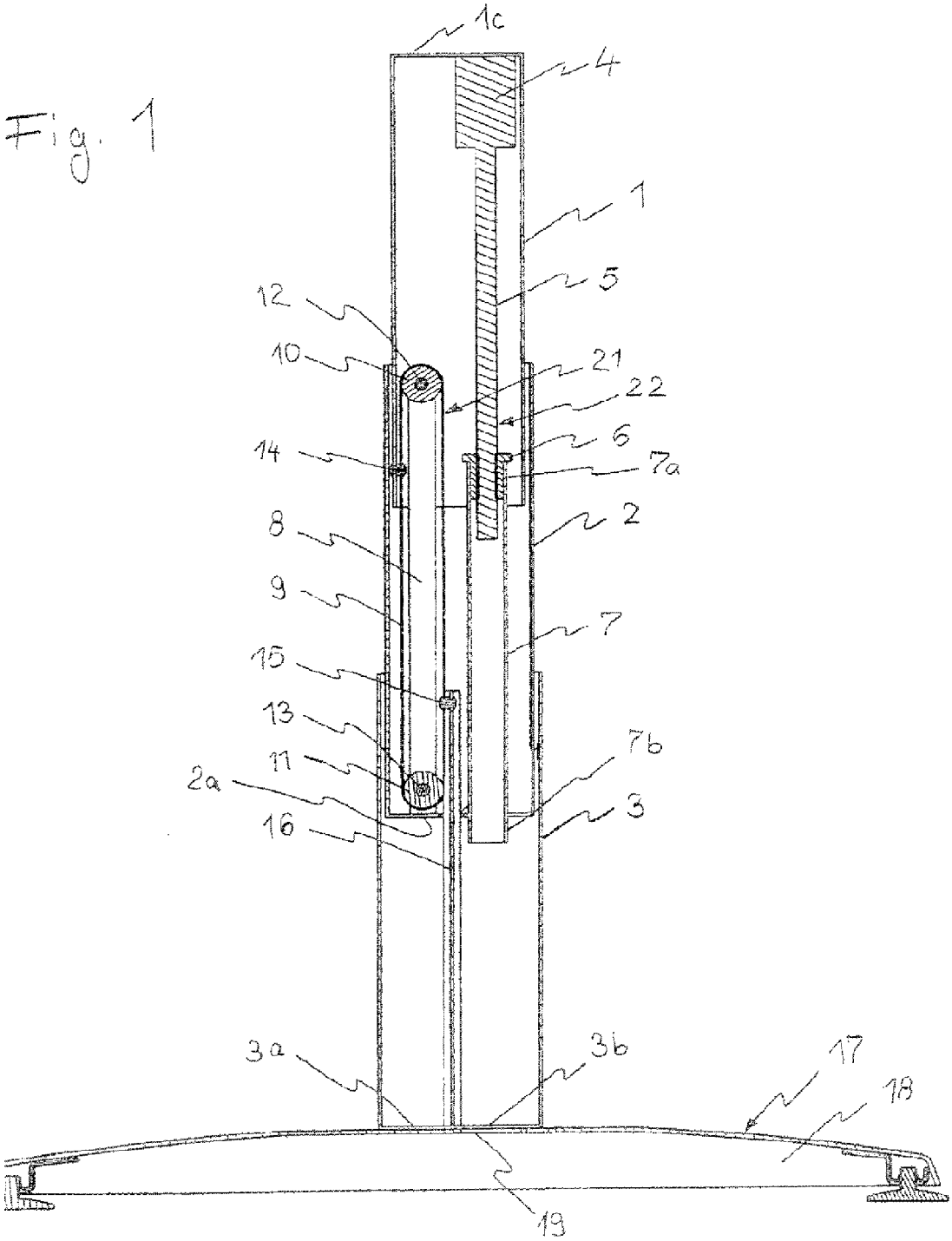
FIG. 1 shows a longitudinal sectional view of a height adjustable table leg including a foot, wherein the height adjustable column is seen in its maximum extended position.

According to FIG. 1, the height adjustable column consists of an inner column 1, an intermediate column 2 and an outer column 3. The inner column 1 has an upper side 1*c* in form of an end plate. The inner column 1 opens downwardly and is formed hollowly on the inside. The intermediate column 2 is open at the upper side and is formed mostly hollow on the inside. It comprises an end plate at its lower side 2*a*. Further, a supporting tube 7 having an upper end 7*a* and lower end 7*b* is provided in the intermediate column. As it can be seen from FIG. 3, the supporting tube 7 has a circular cross-section. As it can be seen from FIGS. 1 and 2, the supporting tube 7 protrudes downwardly beyond an opening in the intermediate column 2, such that the lower end 7*b* protrudes beyond the end of the intermediate column, i.e. the lower side 2*a* of the intermediate column 2. The length of the supporting tube 7 approximately amounts to two thirds of a length of the intermediate column. The length mainly depends on the dimensions of a drive motor 4 described later on more detailed, and in particular depends on the axial length of the drive motor. The overall length of the drive motor taken together with the supporting tube section located inside of the intermediate column amounts to the overall length of the intermediate column. The intermediate column 2 corresponds in its length to about the length of the inner column 1.

The outer column 3 is formed hollow and opens upwardly. At its lower side 3*a* it is closed by a cover. However, the cover comprises an opening 3*b*. Further, a bearing rod 16 is provided at the lower side 3*a* which, as it can be seen from FIG. 3, comprises an I-profile. The bearing rod 16 straightly protrudes upwardly and has a length roughly corresponding to the length of the outer column 3. At the upper end of the bearing rod 16, a fixing 15 towards the outer column's side is provided. It connects the bearing rod 16 with a lifting mechanism 21 to be described later on.

In the following, the linear actuator 22 is described in more detail with reference to FIGS. 1 and 2. In the present embodiment, the linear actuator consists of an electric driving motor 4 out of which a threaded spindle 5 protrudes which can be rotated by the driving motor. The driving motor 4 is fixed to the inner side of the upper side 1*c* of the inner column 1. At the upper end 7*a* of the supporting tube 7, a spindle nut 6 is provided which is rotationally fixedly connected with the supporting tube 7. The spindle nut possesses an inner thread into which the threaded spindle can be screwed in. The pitch of the threaded spindle 5 and the spindle nut preferably is configured such that a self-locking of the threaded spindle with respect to the spindle nut is possible in any adjustment position such that no extra braking device for the drive has to be provided, and the threaded spindle is fixed in the respective positions, when the electric drive is switched off.

As a matter of principle, alternatively, a plunger can be combined with a pneumatic spring, whereas, however, a braking device has to be provided.

In the following, the lifting mechanism 21 is explained in more detail. The lifting mechanism essentially consists of a thrust plate 8, two pairs of return pulleys 10 and 11 at the upper and the lower end of the thrust plate, respectively, which are rotatably supported by respective axes 12 and 13. The thrust plate 8 is fixed to the lower side 2*a* of the intermediate column 2. A revolving steel belt 9 is provided on the return pulleys 10 and 11. The steel belt is firmly connected to the upper end of the bearing rod 16 via a fixing 15 at the outer column's side, and thus is secured in this position. At the opposite side of the thrust plate 8, the steel belt 9 is firmly connected to the inner column 1 via a fixing 14 at the inner column's side. The fixing 14 at the inner column's side is provided in the lower end area of the inner column 1. As it can be seen from FIG. 2, "lower area" is understood to be the area of the inner column 1 opposing the upper side 1*c*. As it can be seen from FIG. 2, the fixing 14 at the inner column's side is located in direct proximity to the lower return pulley 11 while the fixing 15 at the outer column's side is located in direct proximity to the return pulley 10, in a retracted state.

In the following, kinematics of the height adjustable column will be explained. As soon as the drive motor 4 is operated and the threaded spindle 5 starts rotating, the threaded spindle 5 moves upwardly out of the supporting tube 7, since the threaded spindle supports itself onto the spindle nut 6 which is fixedly provided in the supporting tube 7. Since the drive motor 4 is fixed to the upper side 1*c* of the inner column 1, the inner tube 1 moves upwardly therewith. As already described, the fixing 14 at the inner column's side, which connects the inner column 1 with the steel belt 9, is provided at the inner column. If the inner column 1 now moves upwardly, the steel belt 9 is inevitably entrained and moved upwardly via the fixing 14 at the inner column's side. However, since the steel belt 9 is fixed to the bearing rod 16 via the fixing 15 at the outer column's side, while the bearing rod is firmly connected with the outer column 3, the movement of the fixing 14 at the inner column's side imposed by the movement of the inner column 1 forces a movement of the intermediate column 2 with respect to the outer column 3. Thus, a synchronous movement of the column elements may occur while operating the driving motor 4, since due to the imposed movement between the inner and the intermediate column 1 and 2, the steel belt 9 of the lifting mechanism 21 is moved.

As an alternative to the described lifting mechanism, also a lifting mechanism via a gear rod is imaginable. In the present embodiment, the linear actuator 22 is configured as an electro-motor-drive with a threaded spindle 5 having a large power density, i.e. having a small installation length and a small diameter of the drive motor 4. The threaded spindle 5 interacts with a short spindle nut 6. However, the drive may be embodied as a crank drive with a threaded spindle. In addition, also further drives like belt drives or fluidic drives are possible.

This simple configuration also results in an appealing slender visual appearance besides an accurate and synchronous mode of operation and can be implemented inexpensively.

Figure 2:
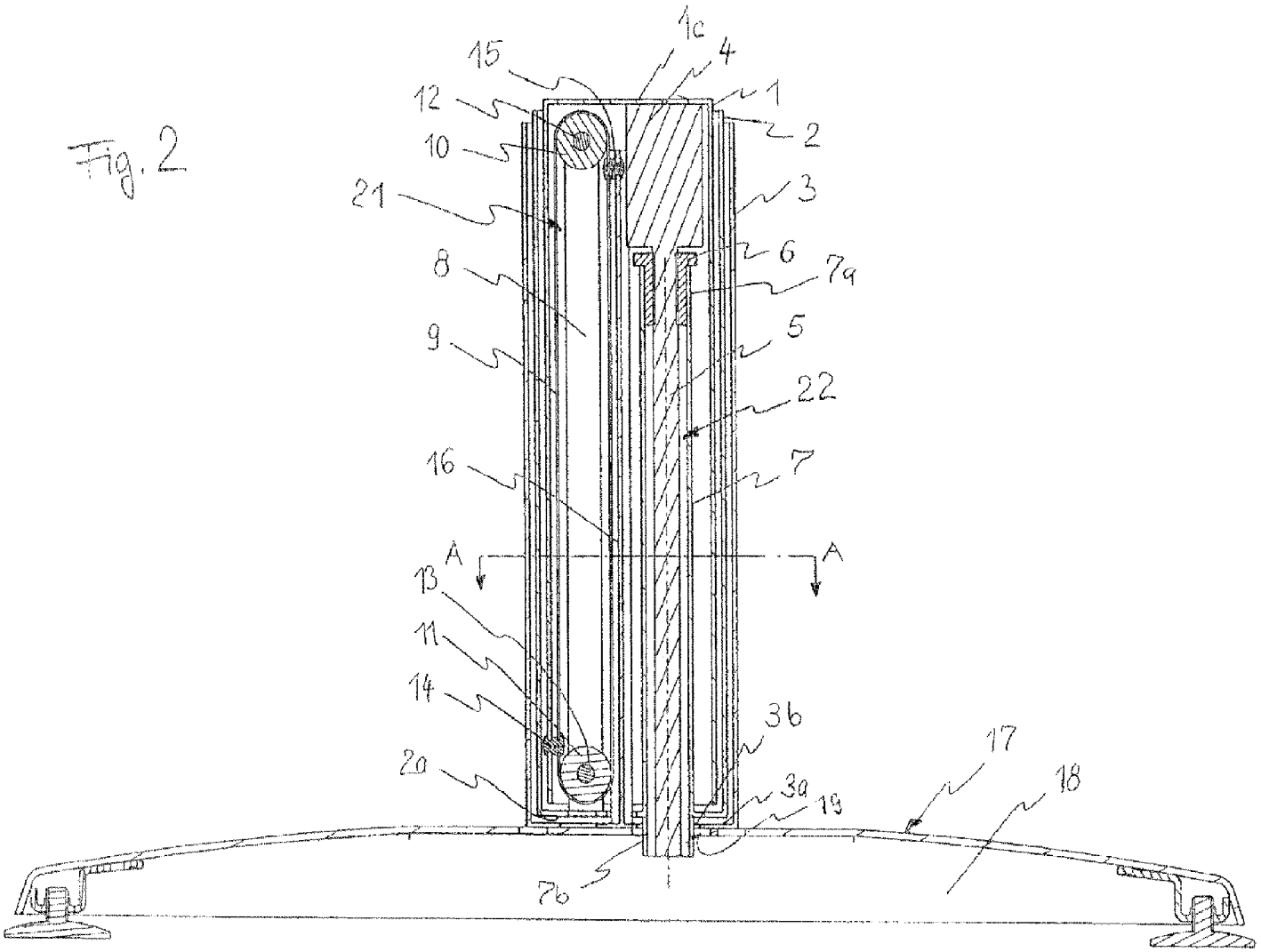
FIG. 2 shows a longitudinal sectional view of the height adjustable column in the retracted state.
Figure 3:
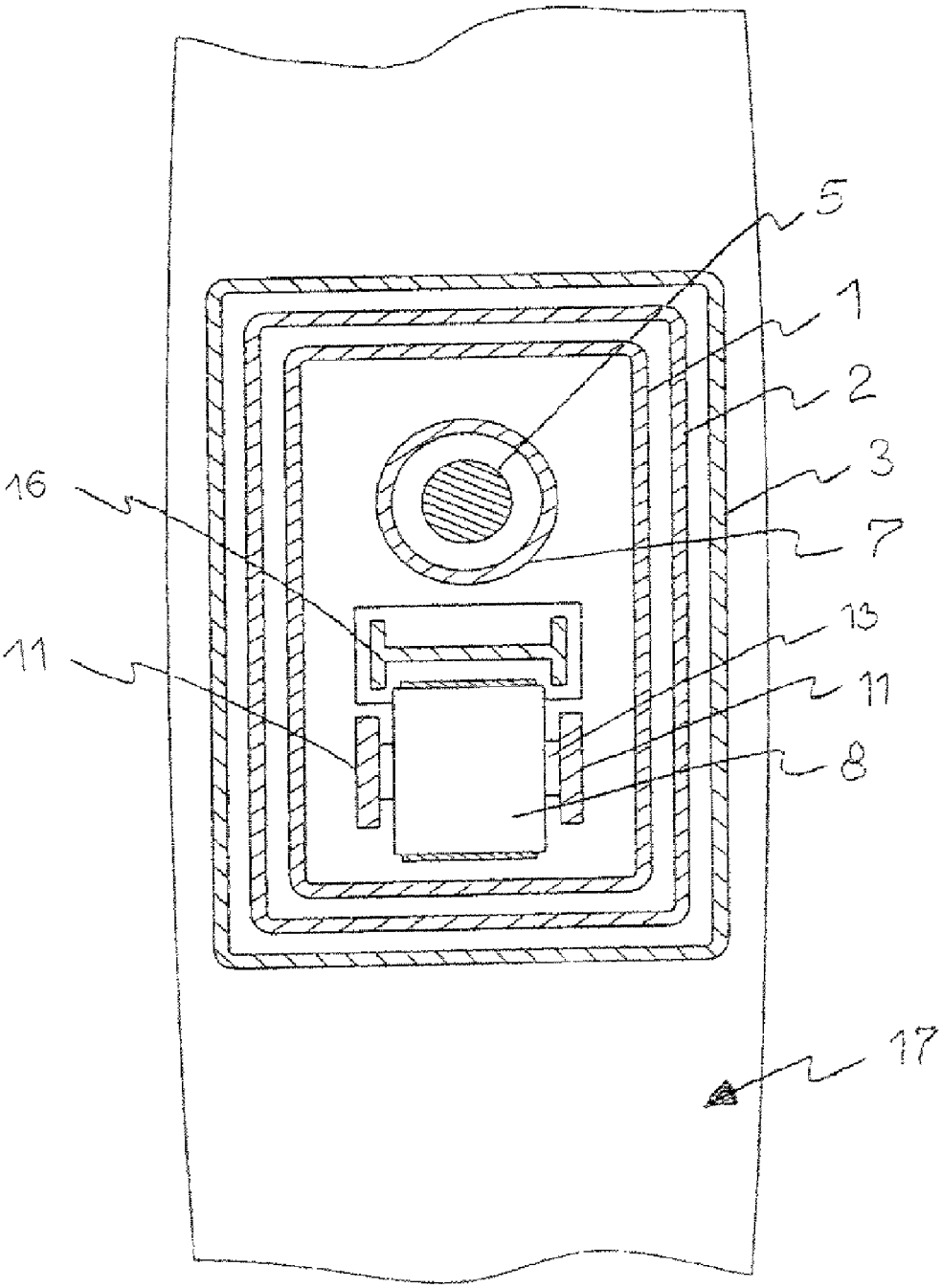
FIG. 3 shows a cross-sectional view according to the cutting line A-A of FIG. 2.

As in particular visible from FIG. 2, the length of the threaded spindle 5 can be maximized by exploiting the hollow 18 of the foot 17. This can be achieved by providing an opening 19 in the foot 17 through which the lower end 7*b* of the supporting tube 7 as well as the threaded spindle 5 also protrudes by the same length into the hollow 18 of the foot 17. Thereby, the length of the threaded spindle 5 and consequently the lifting height of the linear actuator can be optimized. The thus optimized height adjustment occurs without negative influence to the visual appearance of the height adjustable column, since the threaded spindle 5 can protrude into the hollow 18 of the foot 17 virtually invisibly. Thereby, a further advantage is achieved that an inexpensive and powerful driving motor 4 can be used, the length of which in an axial direction of the inner column 1 does not dramatically restrict the lifting height, since a corresponding lifting height can be compensated by the protruding of the threaded spindle 5 into the hollow 18 of the foot 17.

The invention claimed is:

1. A height adjustable column, comprising:

an inner column;

an intermediate column having a lower side;

an outer column having a lower side;

a lifting mechanism having at least a twofold transmission; and a linear actuator;

wherein the height adjustable column is adapted to effect height adjustment by sliding the columns into each other and apart from each other; and wherein the linear actuator is dimensioned and arranged such that it protrudes beyond the lower side of the outer column in a state in which the columns are slid into each other.

2. The height adjustable column of claim 1, wherein a foot is provided at the lower side of the outer column, the foot including a hollow and an opening which opens towards the hollow, and into which opening the linear actuator protrudes in the state in which the columns are slide into each other.

3. The height adjustable column of claim 1, wherein a seating extends from the lower side of the intermediate column upwardly, and wherein further the seating accommodates the linear actuator, which supports itself thereon.

4. The height adjustable column of claim 1, wherein the linear actuator comprises a driving motor and a threaded spindle, wherein the driving motor supports itself on the inner column and the threaded spindle extends downwardly in a longitudinal direction of the driving motor and supports itself on the intermediate column via a spindle nut and screws itself therealong.

5. The height adjustable column of claim 4, wherein the spindle nut is fixed to a hollow supporting tube which is provided in the intermediate column and extends in parallel thereto, such that the threaded spindle can move into the supporting tube.

6. The height adjustable column of claim 5, wherein the supporting tube opens downwardly and a lower end thereof extends beyond the lower side of the intermediate column.

7. The height adjustable column of claim 6, wherein the lower end of the supporting tube protrudes through the opening of the foot into the hollow.

8. The height adjustable column of claim 2, wherein a bearing rod extending in parallel to the outer column is provided at one of the lower end of the outer column or at the foot, the lifting mechanism supporting itself on an upper end of the bearing rod.

9. A height adjustable column, comprising:

an inner column;

an intermediate column having a lower side;

an outer column having a lower side;

a lifting mechanism having at least a twofold transmission; and a linear actuator;

wherein the height adjustable column is adapted to effect height adjustment by sliding the columns into each other and apart from each other;

wherein the linear actuator is dimensioned and arranged such that it protrudes beyond the lower side of the outer column in a state in which the columns are slid into each other; and wherein a seating extends from the lower side of the intermediate column upwardly, and wherein further the seating accommodates the linear actuator, which supports itself thereon.

10. A height adjustable column, comprising:

an inner column;

an intermediate column having a lower side;

an outer column having a lower side;

a lifting mechanism having at least a twofold transmission; and a linear actuator;

wherein the height adjustable column is adapted to effect height adjustment by sliding the columns into each other and apart from each other;

wherein the linear actuator is dimensioned and arranged such that it protrudes beyond the lower side of the outer column in a state in which the columns are slid into each other;

wherein the linear actuator comprises a driving motor and a threaded spindle; and wherein the driving motor supports itself on the inner column and the threaded spindle extends downwardly in a longitudinal direction of the driving motor and supports itself on the intermediate column via a spindle nut and screws itself therealong.

11. The height adjustable column of claim 10, wherein the spindle nut is fixed to a hollow supporting tube which is provided in the intermediate column and extends in parallel thereto, such that the threaded spindle can move into the supporting tube.

12. The height adjustable column of claim 11, wherein the supporting tube opens downwardly and a lower end thereof extends beyond the lower side of the intermediate column.

13. The height adjustable column of claim 12, wherein the lower end of the supporting tube protrudes through the opening of the foot into the hollow.

* * * * *